United States Patent [19]

Converse

[11] Patent Number: 4,742,981

[45] Date of Patent: May 10, 1988

[54] SURGICAL SUPPORT SYSTEM

[76] Inventor: Maurice Converse, 3349 S. Smith Rd., Akron, Ohio 44313

[21] Appl. No.: 16,431

[22] Filed: Feb. 19, 1987

[51] Int. Cl.[4] ..... E04G 3/08

[52] U.S. Cl. ..... 248/231.7; 248/200.1; 269/902

[58] Field of Search ..... 248/231.7, 200, 214, 248/225.31, 121, 122, 230, 323, 333; 269/332, 328; 5/443, 444

[56] References Cited

U.S. PATENT DOCUMENTS

| | | | |
|---|---|---|---|
| 988,923 | 4/1911 | Bauerfeind | 269/328 |
| 1,296,722 | 3/1919 | Washburn | 269/328 X |
| 2,689,995 | 9/1954 | Smith | 248/230 X |
| 3,327,310 | 6/1967 | Bethune et al. | 248/200.1 X |
| 4,158,896 | 6/1979 | Farfas | 248/200.1 X |
| 4,270,721 | 6/1981 | Mainor | 248/231.7 X |
| 4,457,502 | 7/1984 | Beach | 269/322 X |
| 4,623,195 | 11/1986 | Avella | 248/230 X |

*Primary Examiner*—Ramon O. Ramirez
*Attorney, Agent, or Firm*—Sughrue, Mion, Zinn, Macpeak & Seas

[57] ABSTRACT

A surgical support assembly includes a telescopic support bar which may be clamped at opposite ends to a pair of conventional IV poles so that the support bar extends across the width of an operating table. A number of accessories such as a tray support bracket, a foot support bracket, and an X-ray shield support bracket are detachably supported on the support bar. Any other conceivable piece of operating room equipment could also be detachably supported on the support bar to assist in the surgical procedure.

6 Claims, 3 Drawing Sheets

FIG. 9
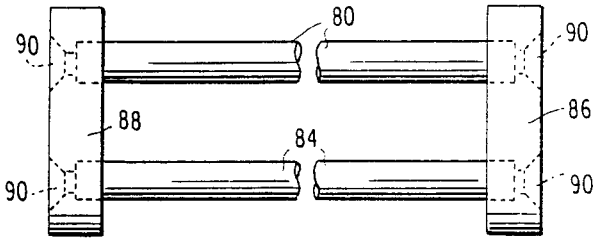
FIG. 10
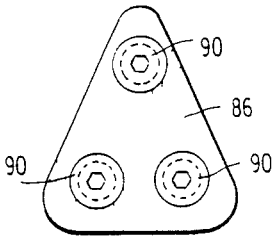
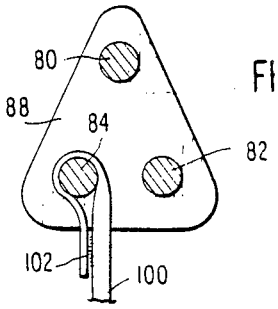
FIG. 11
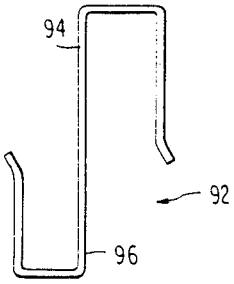
FIG. 12
FIG. 13
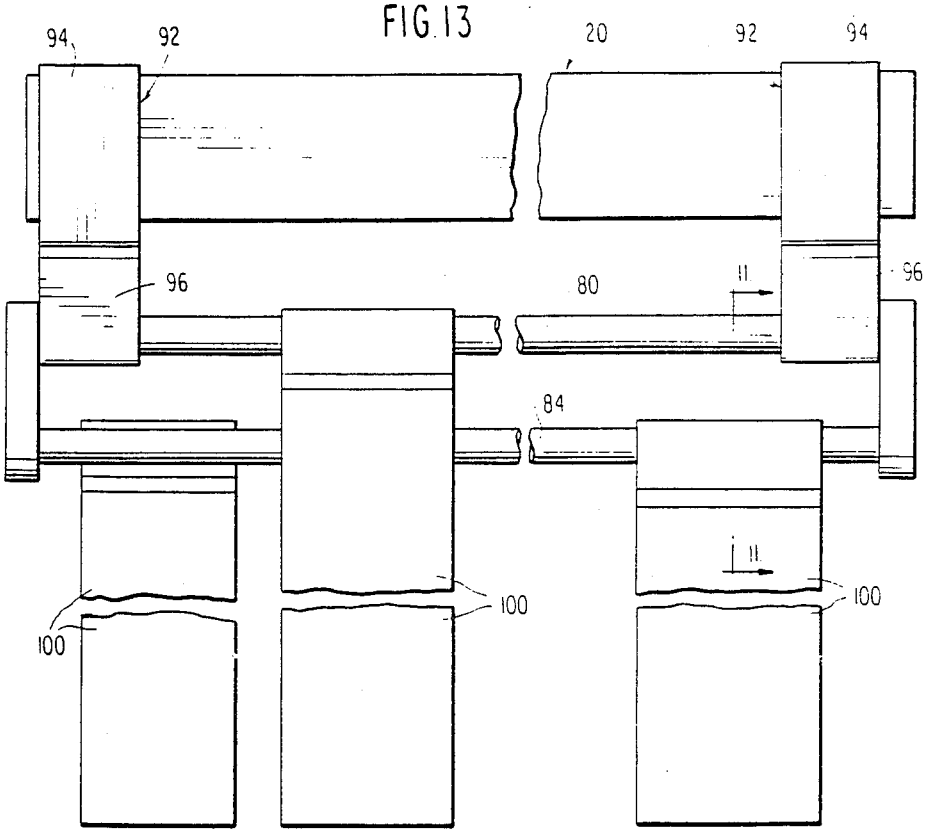

SURGICAL SUPPORT SYSTEM

BACKGROUND OF THE INVENTION

The present invention is directed to a surgical support system and more specifically to an adjustable support bar adapted to be adjustably secured to standard IV poles disposed on opposite sides of an operating table and accessories to assist in surgical procedures adapted to be detachably connected to the support bar.

During an operation the provision of an instrument tray is considered to be an absolute necessity. In the past, such instrument trays were generally supported by a separate roll around stand dedicated solely to the support of the instrument tray. Such a roll around support stand would generally interfere with other roll around devices such as IV poles and surgically related equipment, all of which must be brought into close proximity to the operating table. Such a roll around support stand for an instrument tray would generally only position the instrument tray at the side of the table or, at best, in a partially overlapping condition with respect to the operating table so that the instruments were not readily positioned adjacent the site of the operation for easy access.

In the past, when it was necessary to support a portion of the patient's body in an elevated position it was necessary to use cumbersome support racks adapted to be inserted beneath the patient or to secure an overhead type of support by means of a bracket to the side of the operating table. In both instances the support apparatus tended to interfere with the surgical procedure being carried out. Furthermore, such prior art support apparatus failed to provide the requisite degree of flexibility to handle different situations and a separate support apparatus was required for each different part of the anatomy.

Frequently during the course of an operation it is necessary to cover those portions of the body not being operated upon with one or more surgical drapes. Such drapes could not always rest completely on the body and it was necessary to suspend some portion of the drape above the body of the patient. Once again, cumbersome support devices were used for holding the drape above the body of the patient such as a framework adapted to rest on the table and extend over the body of the patient. Other jury rigged arrangements involved tying the ends of the drape to IV poles disposed adjacent the operating table or to any other convenient type of support which happened to be nearby. However, such an arrangement allows the drapes to sag and to be easily displaced. Also during the course of an operation it was frequently necessary to take X-rays of the patient while the patient was on the operating table. Accordingly it was necessary to shield operating room personnel from undue exposure to radiation. X-Ray shields were generally worn in the form of lead aprons for absorbing the X-rays. However, the anesthesiologist at the head of the patient was frequently required to turn around to operate equipment and was not fully protected by an apron under such circumstances.

SUMMARY OF THE INVENTION

The present invention provides a new and improved surgical support system which overcomes the drawbacks discussed above with respect to prior art procedures and apparatus.

The present invention provides and improved surgical support system which is comprised of an adjustable surgical support bar adapted to be detachably and adjustably secured to a pair of standard IV poles which are adapted to be positioned on opposite sides of an operating table. A number of operating room accessories can be detachably supported on the surgical bar, such as a tray support bracket whereby the instrument tray may be positioned directly over the patient adjacent the site of the operation. Other accessories include foot supporting brackets adapted to be detachably secured to the surgical bar and lead shield supporting rod means adapted to be detachably secured to the surgical bar. In addition surgical drapes and ether screens may be fastened directly to and supported by the surgical bar in any desired position relative to the patient. A plurality of surgical support bars can be used during a single operation depending upon the requirements of the operation. The cross-bars on conventional IV poles can, of course, also be used to support fluid containers and other accessories necessary to carry out the surgical procedure.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 9 is a side elevation view of an X-ray shield support bar assembly.

FIG. 10 is an end elevation view of the assembly shown in FIG. 9.

FIG. 11 is a sectional view taken along the line 11—11 in FIG. 13 without the support bracket.

FIG. 12 is an end elevation view of a support bracket for supporting the assembly shown in FIG. 9 from the bar in FIGS. 1 and 2.

FIG. 13 is a side elevation view showing the assembly of FIG. 9 supported from a surgical support bar.

DETAILED DESCRIPTION OF THE INVENTION

Figure 1:
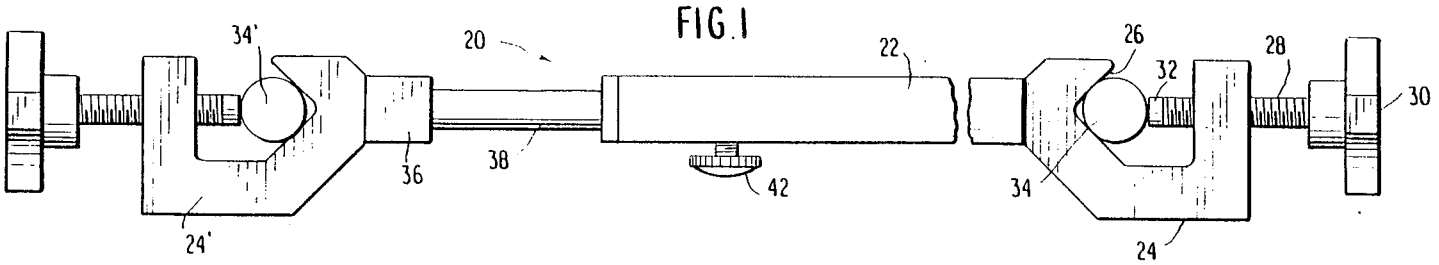
FIG. 1 is a top plan view of a surgical support bar according to the present invention.
Figure 2:
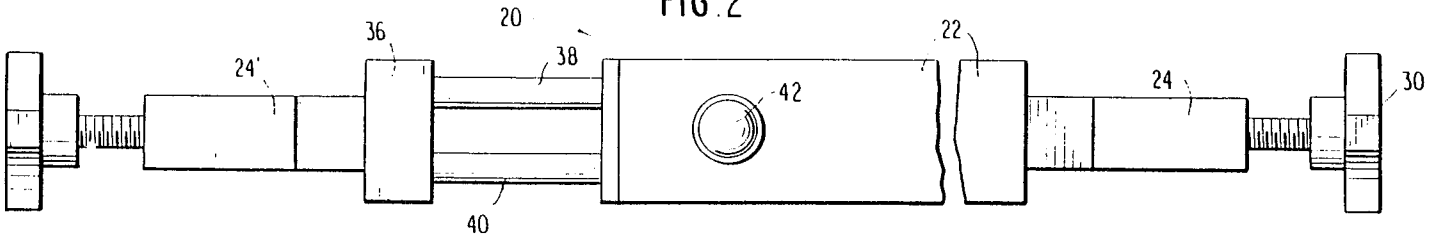
FIG. 2 is a side elevation view of a surgical support bar as shown in FIG. 1.

The surgical support bar 20 shown in FIGS. 1 and 2 is comprised of an elongated main member 22 having a substantially hollow rectilinear cross section having a C-shaped clamping member 24 secured to one end thereof by any suitable means, such as welding or the like. One leg of the C-shaped clamping member 24 is provided with an internally facing V-shaped notch 26 and a threaded rod 28 extending through a threaded aperture in the other leg of the C-shaped clamping member 24 has a hand wheel 30 secured to one end and an abutment 32 secured to the other end. Upon moving the abutment toward the V-shaped notch 26 a standard IV pole 34 will be clamped therebetween to support the surgical bar 20 at the desired elevation. An auxiliary member 36 has a pair of parallel rods 38 and 40 extending from one end thereof in telescopic sliding relation with the main member 22. A suitable clamping member (not shown) is disposed within the main member 22 and operable by a knob 42 for clamping the rods 38 and 40 in the desired telescopic position within the main member 22. A C-shaped clamping member 24', identical to the C-shaped member 24 is secured to the other end of the auxiliary member 36 for clamping the surgical bar 20 to a second standard IV pole 34' at the desired elevation. The surgical support bar 20 can be secured to the IV poles at approximately the desired height and the IV poles with the surgical support bar secured thereto can be rolled into position at any time before or during an operation with the surgical support bar extending over the width of the operating table for any desired support function as it occurs. The height of the surgical support bar can readily be varied even during an operation and the various accessories, which will be described hereinafter, can readily be added to or removed from the surgical support bar at any time. The IV poles can be stabilized to prevent tipping by the use of pole weights such as those disclosed in Applicant's copending U.S. patent application Ser. No. 853,242, filed Apr. 17, 1986.

Figure 5:
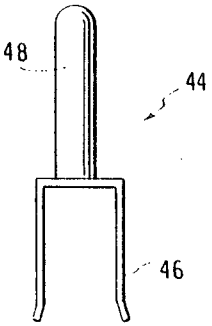
FIG. 5 is an end elevation view of the foot support bracket as shown in FIG. 4.
Figure 4:
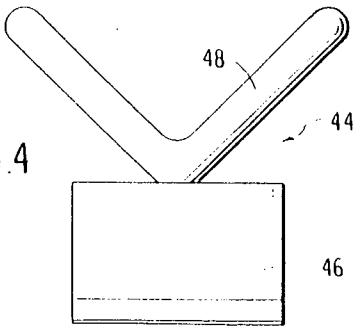
FIG. 4 is a side elevation view of a foot support bracket adapted to be detachably secured to the bar of FIGS. 1 and 2.
Figure 3:
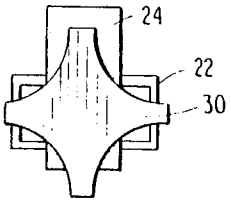
FIG. 3 is an end elevation view of the right end of the support bar as viewed in FIGS. 1 and 2.

If it is necessary to elevate one or both feet of the patient lying on the operating table one or more foot support brackets 44, as shown in FIGS. 4 and 5, may be detachably mounted over the upper surface of the surgical support bar 22. Each foot support bracket is comprised of an inverted U-shaped clip member 46 having a V-shaped rod 48 secured at the apex thereof to the clip 46 by any suitable means, such as welding or the like. The clip portion 46 may have inherent resiliency in order to frictionally grip the surgical support bar 22 in order to hold the foot support bracket 44 in the desired position on the bar.

Figure 6:
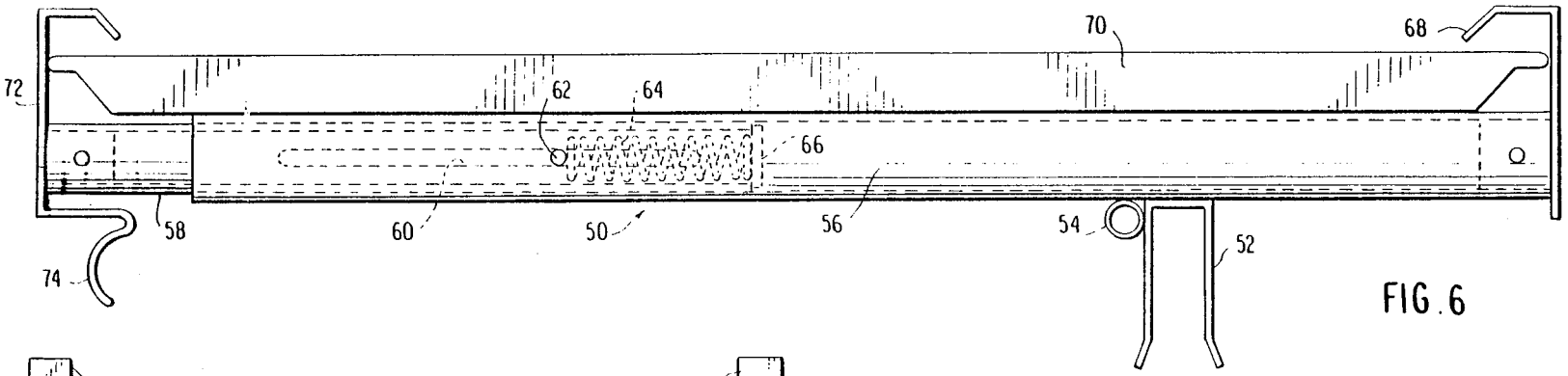
FIG. 6 is a side elevation view of a surgical tray support bracket adapted to be detachably secured to the bar of FIGS. 1 and 2.
Figure 8:
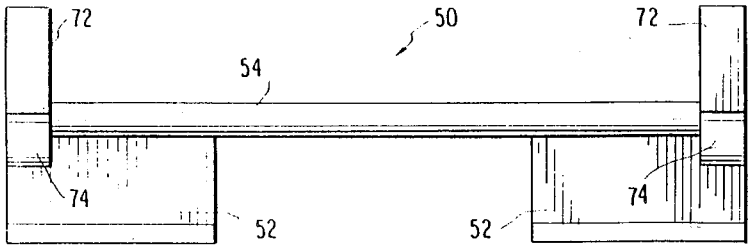
FIG. 8 is an end elevation view of the support bracket shown in FIG. 6 without the tray.
Figure 7:
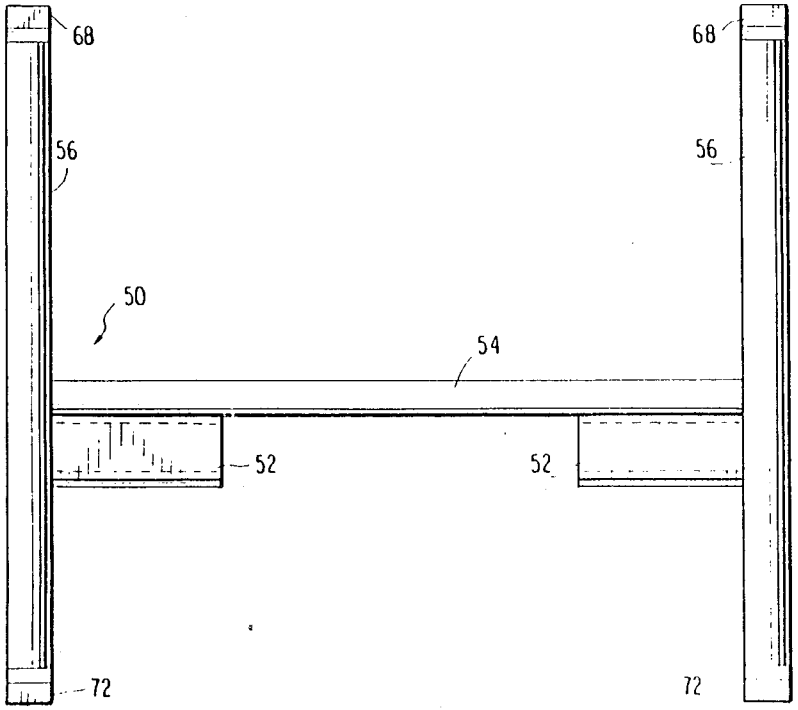
FIG. 7 is a top plan view of the support bracket shown in FIG. 6 without the tray.

A tray support bracket, as shown in FIGS. 6–8, inclusive, may also be detachably secured to the surgical support bar 22 by means of one or more U-shaped resilient clips 52. The clips 52 may be secured in spaced apart relation to a transversely extending tubular member 54 by any suitable means, such as welding. In lieu of the two separate clips 52, as shown in FIGS. 7 and 8, a single elongated clip could extend along the entire length of the tubular member 54.

A pair of identical, hollow, elongated tray support tubes 56 are secured to a tubular member 54 and the clips 52 by any suitable means, such as welding or the like. The tray support tubes 56 extend parallel to each other and a pair of hollow tubes 58, having external diameters smaller than the internal diameters of the tubes 56, are telescopicly received within the tubes 56. Each tube 58 is provided with a pair of elongated slots 60 along opposite sides thereof and a pin 62 secured to and extending transversely across the internal width of each tube 56 extends through the slots 60 in the internal tubes 58. A spring member 64 is secured within each tube 58 between an end abutment 66 and the pin 62 so as to normally bias the tube 58 into telescoping relation with respect to the tube 56. A first end bracket 68, adapted to overlie one side of the tray 70, is secured to one end of each of the tubes 56 and a second bracket 72, adapted to overlie the opposite side of the tray 70, is secured to the opposite end of each tube 58. The bracket 72 is substantially identical to the bracket 68, but is further provided with a downwardly depending finger grip portion 74. Thus, when it is desired to secure a tray on the tray support 50, it is only necessary to grip the finger portion 74 of each bracket 72 to pull the tubes 58 outwardly from the tubes 56 against the force of spring 64. With the tubes 58 extended a tray 70 can readily be placed on the support bracket 50 and upon release of the finger portion 74 the springs 64 will move the tubes 58 inwardly so as to securely grip the opposite sides of the tray between the brackets 68 and 72. It is possible to eliminate the springs 64 and provide a frictional fit for the telescoping tubes to clamp the tray in position. It is also possible to weld or otherwise secure brackets directly to different size trays for mounting the trays directly on the surgical support bar 20.

An X-ray shield support assembly is shown in FIGS. 9–13 which may also be supported from the surgical support bar 20 shown in FIGS. 1 and 2. The assembly is comprised of three parallel rods 80, 82, and 84, which are maintained in a triangular configuration relative to each other by means of a pair of triangular end plates 86 and 88 which are secured to opposite ends of the rods by means of screws 90. The rod assembly is adapted to be supported from the surgical support bar 20 by means of a pair of brackets 92, as shown in FIGS. 12 and 13. Each bracket 92 has an inverted U-shaped portion 94 and an upwardly opening U-shaped portion 96. The inverted U-shaped portion 94 is adapted to be detachably secured in a resilient manner to the support bar 20 and the uppermost rod 80 is adapted to be secured in the upwardly opening U-shaped portion 96 of each bracket 92.

A plurality of flexible lead shields 100 having a substantially rectangular configuration are enclosed in a suitable fabric or plastic covering. The upper end of the covering extends over a respective rod, as best seen in FIG. 11 and is secured to the covering by means of a detachable fastener 102 of the type having a plurality of complementary hooks and loops or any other suitable type fastener. Thus the X-ray shields 100 may be detachably secured to the rods. It is also possible to have one of the end plates 86 or 88 detachably secured to the rods. Thus a permanent loop may be formed at the upper end of each shield covering so that the shields may be slid on or off the rods from one end thereof. Although only a single X-ray shield 100 is shown secured to each of the rods 80, 82, and 84, in FIG. 13, a plurality of X-ray shields 100 may be secured to each rod depending upon the widths of the individual shields. Thus the shields may be moved into an overlapping relationship with respect to each other to provide a complete shield. The flexible shields 100 depend downwardly from the rod assembly into close proximity to the patient. Thus the shields may be of differnt lengths so that the longer shields may be disposed on opposite sides of the patient. The shields 100 can also be pushed to one side or the other to provide access to the patient as needed.

Although it has not been illustrated, it is obvious that the conventional flexible surgical drapes used in operating rooms may be suspended from the surgical support bar 20 by suitable clips or by merely being draped over the support bar 20. Almost any conceivable type of operating room equipment could also be mounted on the surgical support bar 20 by means of proper brackets or clips similar to those illustrated and described above. The surgical support bar 20 can readily be moved along the length of the operating table and be disposed at any angle relative thereto. A plurality of surgical support bars 20 may also be used and since the surgical support bars 20 are mounted on conventional IV poles the IV poles can also be used for their customary purpose of supporting bags of IV solution or plasma from the top cross bars. For that matter, any other type of suitably related medical equipment can also be suspended from the conventional IV poles so as to minimize the number of stands disposed adjacent the operating table thereby making it more convenient for the surgeon and surgical assistants to move about the table. During some surgical procedures it is desirable to suspend an arm or a leg in an elevated position. The surgical support bar 20 provides an ideal support for such a function. The surgical support bar 20, as well as all of the ancillary brackets, rods and the like, are preferably made for stainless steel so as to faciliate cleaning of the equipment. However, any other suitable material may be used under varying conditions.

While the invention has been particularly shown and described with reference to preferred embodiments thereof it will be understood by those in the art that the foregoing and other changes in form and details may be made therein without departing from the spirit and scope of the invention.

What is claimed is:

1. A surgical support assembly adapted to be suspended above an operating table between standard IV poles comprising telescopic support bar means having a rectilinear cross sectional configuration and identical clamp means secured to opposite ends of said support bar means for adjustably clamping the support bar means at any desired height to a pair of standard IV poles, wherein said telescopic support bar means is comprised of a main bar having a rectilinear cross sectional configuration and an auxiliary portion telescopically slidable therein to vary the length of the telescopic support bar means and clamping means for holding the main portion and auxiliary portion oat the desired adjusted length position, and wherein each clamp means is comprised of a substantially C-shaped member having a V-shaped notch on one leg thereof and an abutment member threadably secured to the other leg thereof for clamping a standard IV pole therebetween.

2. A surgical support assembly adapted to be suspended above an operating table between standard IV poles comprising telescopic support bar means having a rectilinear cross sectional configuration and clamp mans secured to opposite ends of said support bar means for adjustably clamping the support bar means at any desired height to a pair of standard IV poles, further comprising foot support means including an inverted U-shaped bracket portion adapted to be placed over said support bar assembly and a substantially V-shaped support member secured to the uppermost surface of the bracket.

3. A surgical support assembly adapted to be suspended above an operating table between standard IV poles comprising telescopic support bar means having a rectilinear cross sectional configuration and clamp means secured to opposite ends of said support bar means for adjustably clamping the support bar means at any desired height to a pair of standard IV poles, further comprising an adjustable tray support bracket having a pair of parallel telescopic tubular assembies, transversely extending support means including clips adapted to support the bracket on said support bar means and bracket means secured to the opposite ends of the telescopic assemblies for gripping a tray therebetween.

4. A surgical support assembly as set forth in claim 3, further comprising spring means operatively connected to said telescopic assemblies for normally biasing said brackets towards each other for gripping a tray therebetween.

5. A surgical support assembly adapted to be suspended above an operating table between standard IV poles comprising telescopic support bar means having a rectilinear cross sectional configuration and clamp means secured to opposite ends of said support bar means for adjustably clamping the support bar means at any desired height to a pair of standard IV poles, further comprising X-ray shield support means including a rod assembly having three parallel rods secured to a pair of end brackets to maintain said rods parallel to each other in a spaced apart triangular configuration, clip means adapted to engage one of said rods and said surgical support bar means for supporting said rod assembly from said support bar means.

6. A surgical support assembly as set forth in claim 5, further comprising a plurality of flexible lead shields having detachable connecting means securing said shields to said rods for longitudinal movement of said shields along the length of each rod.

* * * * *